US010533314B2

(12) United States Patent
Lastowski et al.

(10) Patent No.: US 10,533,314 B2
(45) **Date of Patent: *Jan. 14, 2020**

(54) INFILL WALL SUPPORT CLIP

(71) Applicant: PatCo, LLC, Arvada, CO (US)

(72) Inventors: Michael Lastowski, Centennial, CO (US); John Louis Vanker, Denver, CO (US)

(73) Assignee: PatCo, LLC, Arvada, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/248,515

(22) Filed: Jan. 15, 2019

(65) Prior Publication Data

US 2019/0145093 A1 May 16, 2019

Related U.S. Application Data

(63) Continuation of application No. 15/676,887, filed on Aug. 14, 2017, now Pat. No. 10,227,771.

(60) Provisional application No. 62/374,535, filed on Aug. 12, 2016.

(51) Int. Cl.

| | |
|---|---|
| ***E04B 1/41*** | (2006.01) |
| ***E04B 1/84*** | (2006.01) |
| ***E04B 2/74*** | (2006.01) |
| ***E04B 2/82*** | (2006.01) |
| *E04B 1/38* | (2006.01) |
| *E04B 1/82* | (2006.01) |

(52) U.S. Cl.

CPC ..... *E04B 1/40* (2013.01); *E04B 1/84* (2013.01); *E04B 2/7457* (2013.01); *E04B 2/821* (2013.01); *E04B 2/7412* (2013.01); *E04B 2001/405* (2013.01); *E04B 2001/8254* (2013.01)

(58) Field of Classification Search

CPC ..... E04B 1/40; E04B 1/84; E04B 2/82; E04B 2/7457; E04B 2/7412; E04B 2001/405; E04B 2001/8254

USPC ..... 52/241, 242, 243.1, 262, 272, 276, 283, 52/289, 39, 410, 489.1, 506.06, 665, 702, 52/712, 92.2, 93.1, 93.2; 248/200, 207, 248/226.11, 228.1

See application file for complete search history.

(56) References Cited

U.S. PATENT DOCUMENTS

| | | | | | |
|---|---|---|---|---|---|
| 2,413,362 | A * | 12/1946 | Maxwell | E04B 1/2608 | 403/219 |
| 2,545,147 | A * | 3/1951 | Jensen | A47H 1/13 | 248/259 |
| 3,589,758 | A * | 6/1971 | King | E04B 1/6141 | 52/584.1 |
| 4,129,279 | A * | 12/1978 | Burkholder | A01K 31/17 | 211/182 |
| 4,932,173 | A * | 6/1990 | Commins | E04B 1/2608 | 403/232.1 |
| 5,640,822 | A * | 6/1997 | Haswell | E04B 1/2608 | 52/702 |

(Continued)

*Primary Examiner* — Patrick J Maestri
*Assistant Examiner* — Joseph J. Sadlon
(74) *Attorney, Agent, or Firm* — Holzer Patel Drennan

(57) ABSTRACT

An infill wall support clip is described. The infill wall support clip provides lateral bracing for wall panels in residential or commercial buildings. The infill wall support clip anchors to a top track of wall panels and to a bottom track of a floor truss. The infill wall support clip provides spacing between the wall panel and the floor truss such that drywall may be continuously overlaid on top of the wall panel.

20 Claims, 9 Drawing Sheets

(56) References Cited

U.S. PATENT DOCUMENTS 6,131,359 A * 10/2000 Duff ..... E04B 5/12 52/514
6,295,781 B1 * 10/2001 Thompson ..... E04B 1/2608 403/232.1
6,357,199 B2 * 3/2002 Laukhuf ..... H02G 3/288 248/300
6,446,409 B1 * 9/2002 Emerson ..... E04B 1/2608 403/232.1
6,510,666 B1 * 1/2003 Thompson ..... E04B 1/2608 52/264
6,922,967 B2 * 8/2005 Collie ..... E04B 7/045 52/656.9
6,964,085 B2 * 11/2005 Boda ..... A47B 57/54 24/489
7,325,367 B2 * 2/2008 Burgess ..... E04B 5/12 248/220.21
7,607,272 B1 * 10/2009 Woolworth ..... E04B 2/82 52/287.1
8,061,672 B1 * 11/2011 Kaufman ..... E04B 2/82 248/228.3
8,337,037 B2 * 12/2012 Hopkins ..... F21S 8/043 362/148
8,590,256 B2 * 11/2013 Kawai ..... E04B 7/024 52/655.1
8,833,030 B2 * 9/2014 Zimmerman ..... E04B 1/2608 248/300
9,342,634 B2 * 5/2016 Onchuck ..... A63H 33/101
9,399,177 B2 * 7/2016 Cochella ..... A63H 33/101
9,512,614 B2 * 12/2016 Klein ..... E04B 5/12 248/220.21
9,879,421 B2 * 1/2018 Pilz ..... H02G 3/288 248/300
10,000,923 B2 * 6/2018 Pilz ..... E04B 7/024 52/655.1
10,267,036 B2 * 4/2019 Kleinhans ..... E04B 5/12 52/514
10,352,035 B1 * 7/2019 Boor ..... F21S 8/043 362/148
2009/0173029 A1 * 7/2009 Socha ..... E04B 1/82 52/506.08
2009/0277125 A1 * 11/2009 Smith ..... E04B 1/84 52/714

* cited by examiner

INFILL WALL SUPPORT CLIP

CROSS-REFERENCE TO RELATED APPLICATIONS

The present application is a continuation application of U.S. patent application Ser. No. 15/676,887 filed on Aug. 14, 2017, and titled "Infill Wall Support Clip" which is hereby incorporated by reference in its entirety. This application claims benefit of U.S. Provisional Application Ser. No. 62/374,535 entitled "Infill Wall Support Clip," and filed on Aug. 12, 2016, which is incorporated herein by reference in its entirety.

BACKGROUND

Residential and/or commercial building structures may include drywall panels for interior walls and/or ceilings. When installing the drywall, pieces of drywall may be cut to fit a particular layout of a room in the building. Cutting and finishing drywall for various room layouts may be labor intensive, which can add significant costs to building construction.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations and implementations as further illustrated in the accompanying drawings and defined in the appended claims.

The present application discloses an infill wall support clip that includes a top flange, a side tab, and a side flange. The top flange is configured to anchor the infill wall support clip to a bottom track of a truss. The side tab is configured anchor the infill wall support clip to a top track of a wall panel. The side flange is between the top flange and the side tab and provides spacing for drywall to be overlaid on top of the wall panel.

BRIEF DESCRIPTIONS OF THE DRAWINGS

DETAILED DESCRIPTIONS

The infill wall support clip described herein provides lateral bracing for partition walls in residential or commercial buildings yet allows drywall to run continuously over the top of the partition walls. This may eliminate costly cutting, taping, and finishing of drywall. It also provides a continuous fire rated assembly and transfers load from trusses to wall panels. The infill wall support clips are brackets that may be securely anchored to the tops of partition walls (e.g., wall panels) and bottoms of ceiling structures such as trusses. The infill wall support clips provide spacing between the tops of the partition walls and the ceiling structures. Drywall and resilient channels are installed in the provided spacing, and the drywall may be installed over the top of the wall panel without significant cutting and fitting. The resilient channels provide support for the drywall and sound insulation. The assembly of the infill wall support clips, drywall, resilient channels, wall panels, and ceiling/floor channels are resistant to spreading fire when compared to other assemblies.

Figure 1:
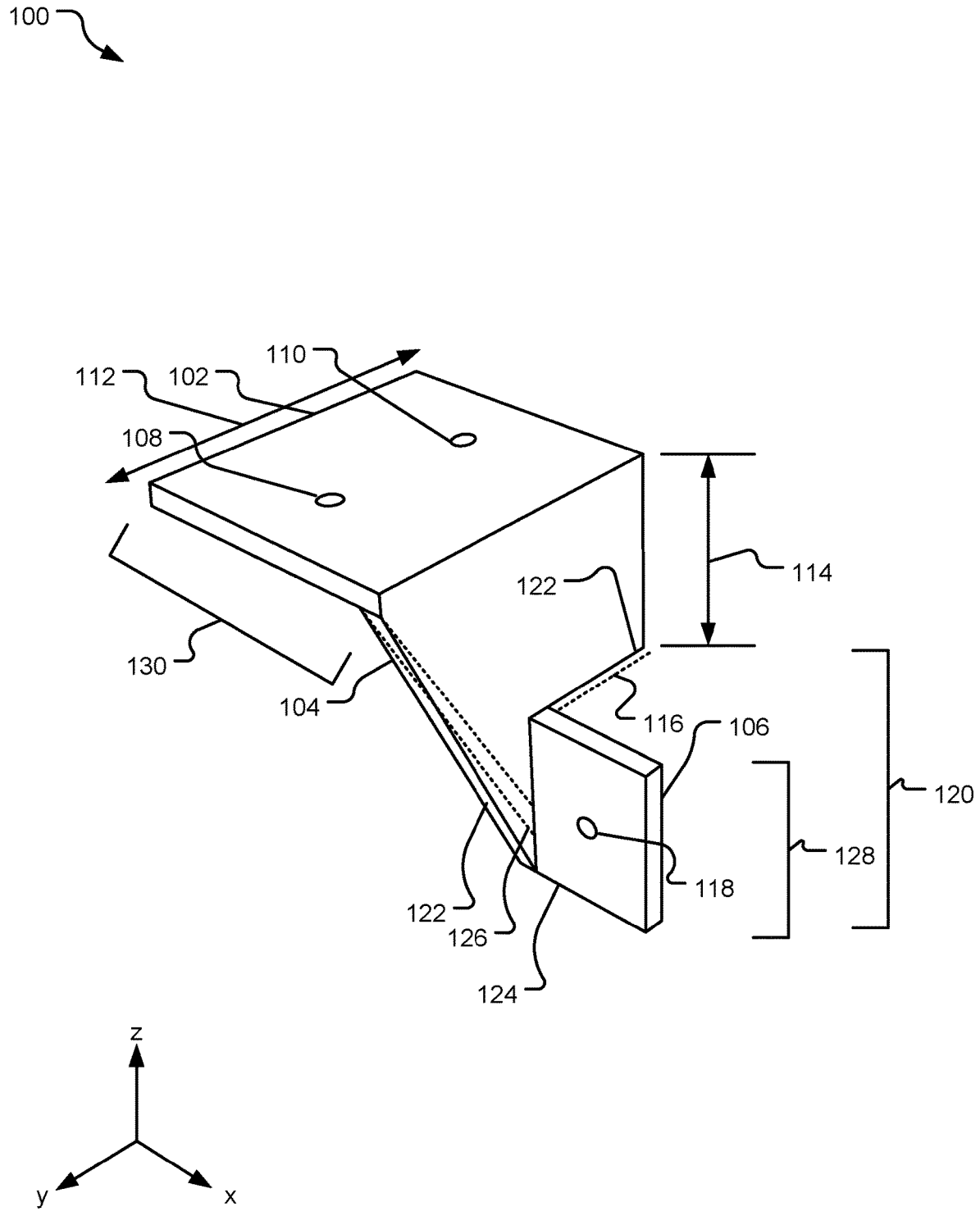
FIG. 1 illustrates an example infill wall support clip.

FIG. 1 illustrates an example infill wall support clip 100. The infill wall support clip includes a top flange 102, a side flange 104, and a side tab 106. The top flange 102 includes pilot holes 108 and 110 positioned along the center of a length (e.g., length 112) of top flange 102. The pilot holes are sized to receive fasteners (not shown) that are configured to attach the infill wall support clip to a bottom track of a floor truss (not shown) of a building structure. The fasteners may include screws, bolts, etc. It should be understood that the top flange may not include any pilot holes, and as such, the pilot holes may be drilled upon assembly of the building. It should be further understood that the top flange may include more than two pilot holes for fasteners.

The side tab 106 is positioned substantially perpendicular to a plane comprising the side flange 104. The side tab includes a pilot hole 118 configured to receive a fastener configured to anchor the infill wall support clip to a top track of a wall of the building structure. The fastener may be a screw, bolt, etc. It should be understood that the side tab 106 may include no pilot holes or more than 1 pilot hole.

The side flange 104 is positioned substantially perpendicular to a plane comprising the top flange 102 and substantially perpendicular to a plane comprising the side tab 106. The side flange 104 is positioned between the top flange 102 and the side tab 106 and is configured to provide spacing (e.g., a space illustrated by line 114) between a top track of a wall (not shown) of the building structure and the bottom track of a floor truss. The spacing provides an opening between the top track of the wall and the bottom track of the floor truss through which drywall (not shown) may be installed. As such, the dry wall may not have to be cut to fit between walls of a building structure. Furthermore, the side flange 104 provides support between the top track of the wall and the bottom track of the floor structure. The size of the spacing defined by the line 114 (e.g., the height of the side flange 104) may vary depending on the depending on implementations. In some example implementations, an edge 122 of the side flange 104 does not extend to a bottom edge 124 of the side tab 106. For example, the edge 122 may be positioned or extend down apportion of the side tab 106 as illustrated by lines 126.

In implementations, the dimensions of the infill wall support clip 100 does not vary with different sizes of components where the infill wall support clip 100 is attached. In some example implementation, a height of the space defined by the line 114 is about 1¼ inches, but it should be understood that other heights are contemplated. Furthermore, in some example implementations, a height 128 of the side tab 106 is about 1 inch, but other heights 128 of the side tab 106 are contemplated. Yet further, in some example implementations, a width 140 of the top flange 102 is about 1½ inches, but other widths 140 are contemplated. In some example implementations, the length 112 of the top flange 102 is about 1¾ inches, but other lengths 112 are contemplated.

The side tab 106 and the side flange 104 form an abutment notch in a space 120. The abutment notch is configured to receive a top track of a wall structure (not shown), such as a wall panel. For example, when installed on the top track, a fastener is inserted through the pilot hole 118 and into a side of the top track. Thus, the side tab 106 rests against the side of the top track. Furthermore, a bottom edge 116 of the side flange 104 rests against the top of the top track. Thus, the abutment notch rests against the top and the side of the top track of the wall panel providing support for the bottom track of the floor truss.

In the illustrated implementation, the top flange 102 is positioned parallel to a plane defined by an x axis and a y axis, the side flange 104 is positioned parallel to a plane defined by the y axis and a z axis, and the side tab 106 is positioned parallel to a plane defined by the x axis and the z axis. The plane defined by the x and y axis is substantially perpendicular to the plane defined by the y and z axis and the plane defined by x and z axis. Furthermore, the plane defined by the y and z axis is substantially perpendicular to the plane defined by the x and y axis and the plane defined by the x and z axis. Yet further still, the plane defined by the x and z axis is substantially perpendicular to the plane defined by the x and y axis and the plane defined by the y and z axis. In some example implementations, the various components of the infill wall support clip are not positioned substantially parallel to the defined planes.

In some example implementations, the infill wall support clip 100 is configured to provide sound insulation in a building structure. For example, the side flange 104 includes slots that dissipate sound vibrations traveling between structures such as the top track of the wall and the bottom track of a truss. Furthermore, the spacing provided by the side flange (e.g., the spacing illustrated by a line 114) provides sound insulation properties and allows for additional sound dissipating elements to be installed. For example, resilient channels may be installed between the drywall and the bottom track of the floor truss. The resilient channels further insulate sound vibrations between various building elements.

In some example implementations, the infill wall support clip 100 may be constructed from a metal sheet. The sheet may be, for example, 12-18 gauge (between 0.050 to 0.11 inches) for stainless steel sheets. However, alternate thickness of the metal sheet may also be used. The metal sheet may be made of stainless steel, galvanized steel, aluminum, etc. For example, if standard steel sheet is used to make the infill wall support clip 100, the thickness of the flanges may be for example, 16-18 gauge standard steel, which equated to thickness of 0.00598 to 0.0478 inches. On the other hand, if galvanized steel sheet is used to make the infill wall support clip 100, the thickness of the flanges may be for example, 16-18 gauge galvanized steel, which equates to thickness of 0.0635 to 0.0516 inches. However, alternate thickness of the metal sheet may also be used.

Such construction may include cutting a piece from the metal sheet, punching the pilot holes for the top flange 102 and the side tab 106, and bending/roll forming the cut piece to the desired shape. The section of the cut piece that includes the side flange 104 and the side tab 106 may be cut to form the side tab 106 (e.g., cut along line 116). After the section is cut, the side tab 106 may be folded, bent, or roll formed into a position as shown in FIG. 1. As such, the edges between the top flange 112 and the side flange 104, and the side flange 104 and the side tab 106 may not be as "sharp" as illustrated. Rather, such edges may be a bent/folded seam. In some example implementations, the infill wall support clip 100 is manufactured using a mold.

Figure 2:
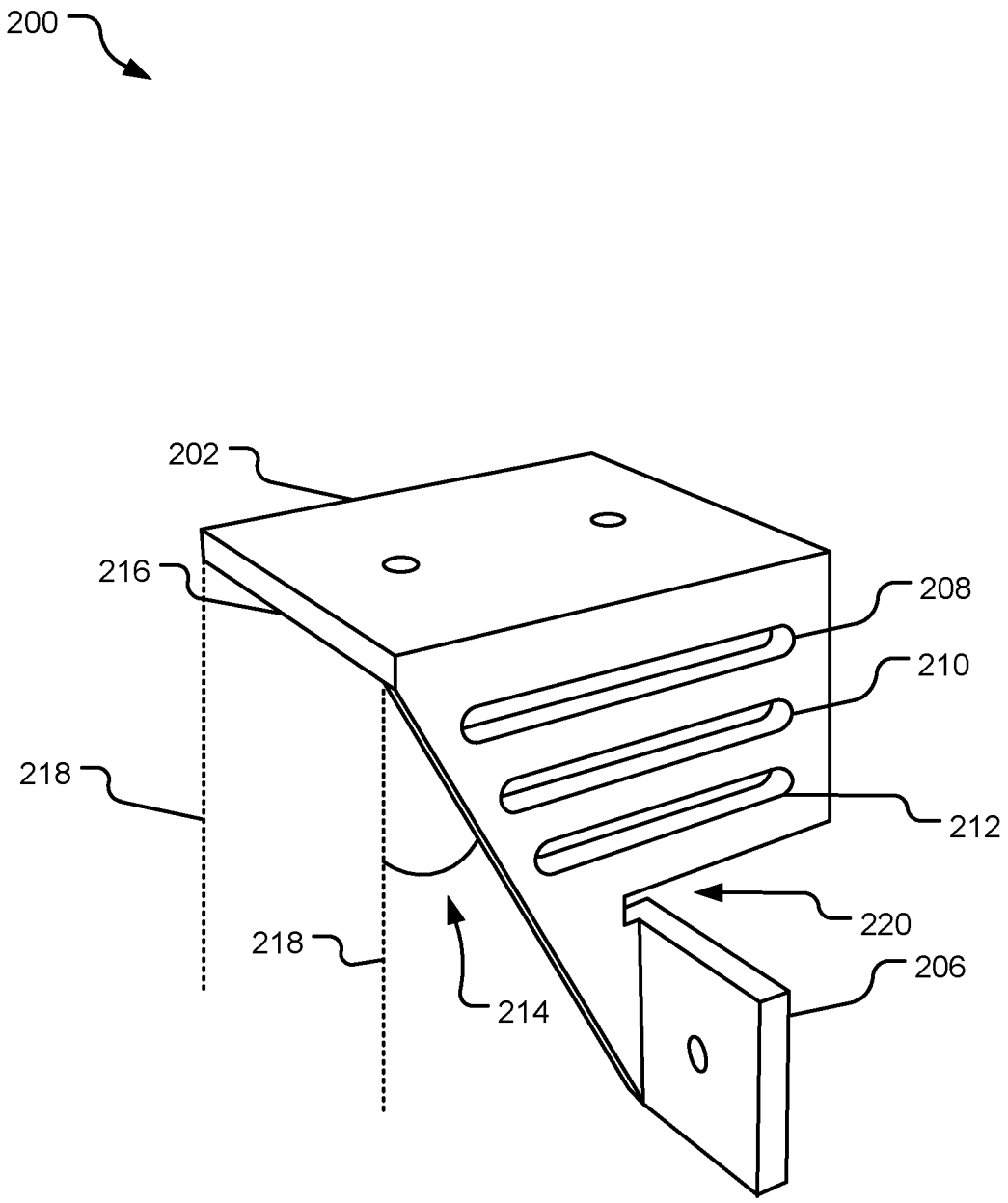
FIG. 2 illustrates another example infill wall support clip.

FIG. 2 illustrates another example infill wall support clip 200. The infill wall support clip 200 includes a top flange 102, a side flange 104, and a side tab 106. Specifically, FIG. 2 illustrates the infill wall support clip 200 having various slots (e.g., slots 208, 210, and 212) formed in the side flange 104. The slots 208, 210, and 212 are configured to insulate/dissipate sound vibrations traveling through various elements of a building structure (e.g., walls and floors). As such, the infill wall support clip 200 with the slots 208, 210 and 212 may provide sound insulating features in a building. It should be understood that other configurations of slots may be employed. For example, the infill wall support clip 200 may include fewer than three slots or more than three slots, and the slots may be sized and shaped different and may be located on different areas of the infill wall support clip 200.

In some example implementations, the side flange 104 is offset from an edge 216 of the top flange 202 at an angle 214. The angle may be from about 10 degrees to about 60 degrees from a plane (illustrated by lines 218) extending from the edge 216 of the top flange 202. In alternative implementations, the side flange 104 is not offset from the edge 216 of the top flange 202. In such implementations, the side flange 104 is a rectangular shaped body.

In FIG. 2, the infill wall support clip 200 includes a notch 220. The notch 220 may be formed as a result of the manufacturing process for the infill wall support clip 200. To form the infill wall support clip 200, a continuous piece of metal/steel may be cut and folded/bent into the shape illustrated. To form the side tab 206, the piece of metal/steel is cut (e.g., using saw, laser, etching device) in the area of the notch 220, and the side tab 206 is folded/bent into the position as illustrated in FIG. 2. The notch 220 is the result of the saw, etching device, laser, etc. removing material such that the side tab 206 may be folded/bent outward into the shape illustrated.

Figure 3:
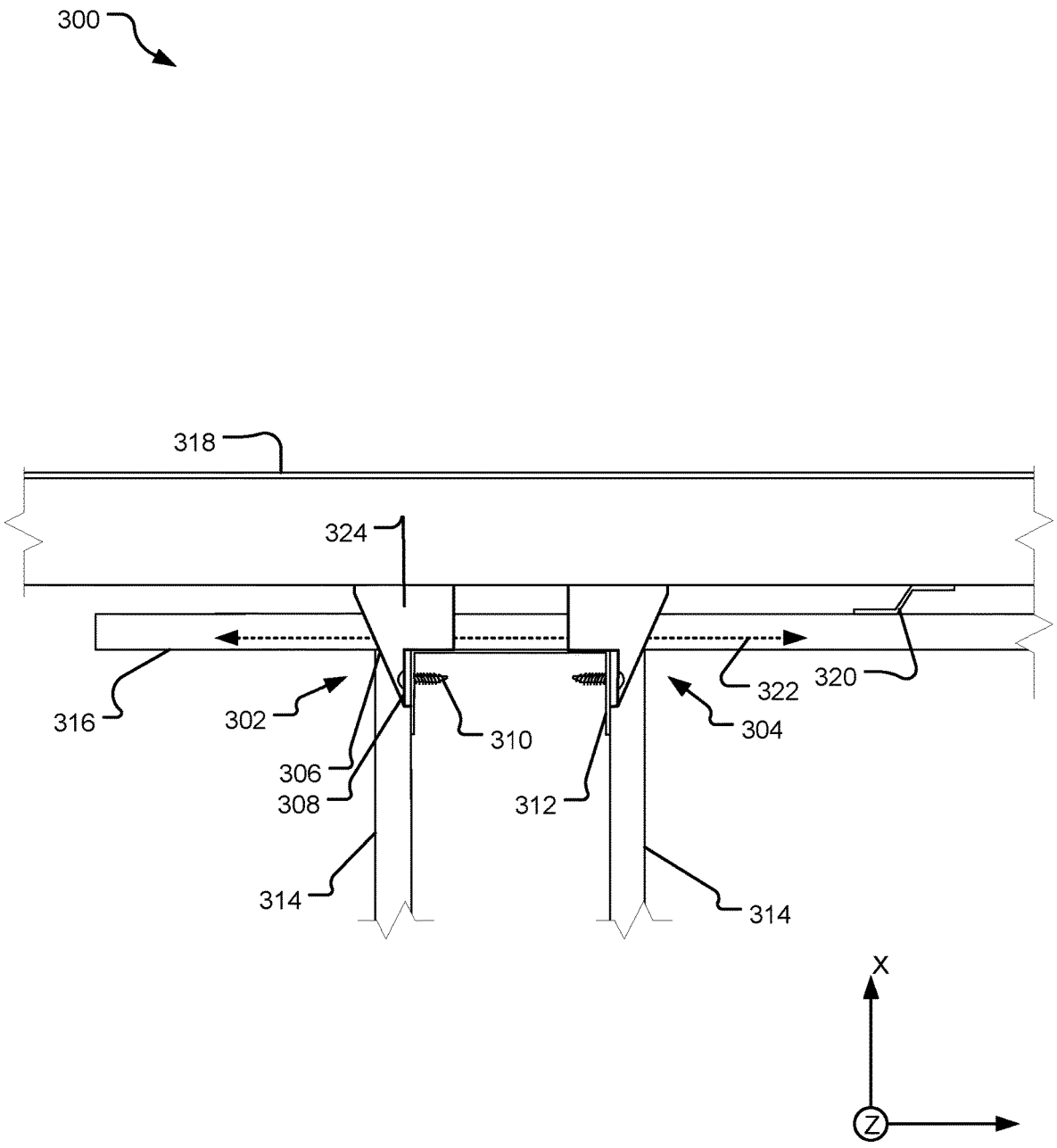
FIG. 3 illustrates an example view of a system including two infill wall support clips and installed between a wall panel and a floor truss.

FIG. 3 illustrates an example view 300 of a system including two infill wall support clips 302 and 304 installed between a wall panel and a floor truss. Note that the implementation in FIG. 3 illustrates two infill wall support clips 302 and 304, in alternative implementations, only one of the two infill wall support clips 302 and 304 may be used to connect a wall to a bottom truss of a floor. Each of the infill wall support clips 302 and 304 include a side flange, a top flange, and a side tab. For example, Infill wall support clip 302 includes a side flange 306, and a side tab 308. The top flanges of infill wall support clips 302 and 304 are not shown, as they extend in the z direction under a bottom track 318 of a floor truss and are anchored to the bottom track 318 via fasteners (not shown). The infill wall support clips 302 and 304 are anchored to a top track 312 of a wall panel via fasteners through the side tabs. For example, the infill wall support clip 302 is anchored to the top track 312 with a fastener 310 through the side tab 308 of the infill wall support clip 302. As described above with respect to FIG. 1, the side tabs and the side flanges of the infill wall support clips 302 and 304 form abutment notches that receive the top track 312.

The infill wall support clips 302 and 304 provide lateral bracing for the partition walls but allow drywall 316 to run continuously over the top of the wall. The infill wall support clips 302 and 304 further transfer vertical loads from the bottom track 318 (e.g., truss) to the wall (e.g., the top track 312). The side flanges (e.g., a side flange 324 of the infill wall support clip 302) provide spacing between the top track 312 of the wall panel and the bottom track 318 of the floor truss wherein a piece of drywall 316 may pass through (illustrated by an arrow 322). This may eliminate costly cutting, tapping, and finishing of the dry wall. The piece of drywall 316 is supported further by resilient channel (RC) 320. Additional drywall 314 is installed on the side of the wall.

The infill wall support clips 302 and 304 further provide sound insulating features. For example, the side flange (e.g., the side flange 324) may include slots for dissipating sound vibrations between the top track 312 and the bottom track 318. Furthermore, the spacing provided by the side flanges allow for the drywall and the resilient channels, such as the resilient channel 320. The resilient channel 320 is connected to the bottom track 318 and the drywall 316 via fasteners, tape, or glue (not shown). The resilient channels further provide sound insulating features as dissipate sound vibrations traveling between the drywall 316 and the bottom track 318.

Figure 4:
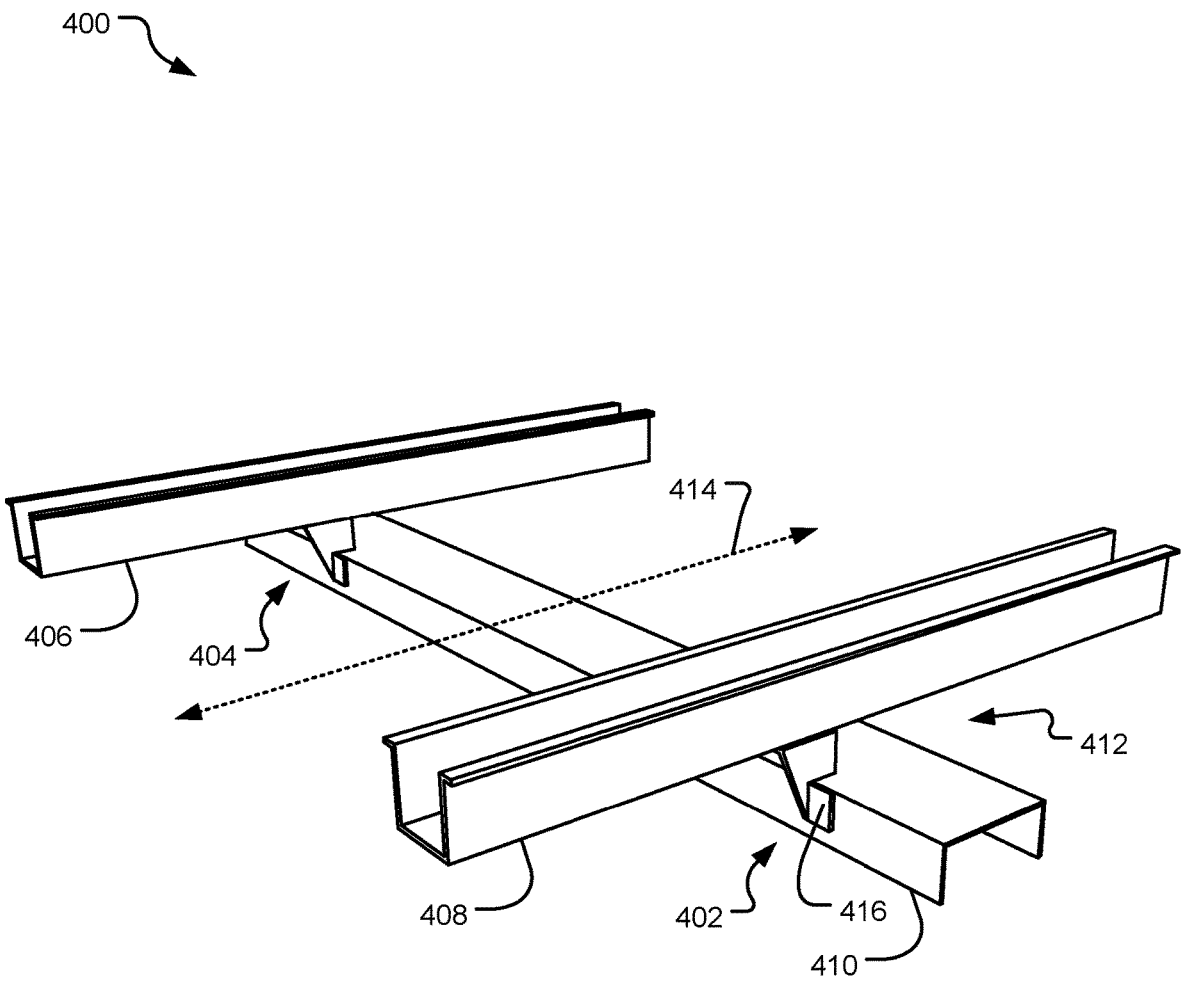
FIG. 4 illustrates another example view of a system including two infill wall support clips installed between a top track of a wall panel a bottom track.

FIG. 4 illustrates another example view 400 of a system including two infill wall support clips 402 and 404 installed between a top track 410 of a wall panel and bottom tracks 406 and 408. One or more pieces of drywall (not shown) may be installed continuously over the top (e.g., illustrated by an arrow 414) of the top track 410 of the wall panel. Infill wall support clips may be installed on the other side (e.g., the side illustrated by 412) of the top track 410 to provide additional lateral support for the wall panel and transfer of vertical load from the truss to the wall. Fasteners (not shown) securely fasten the infill wall support clips to the top track 410 and the bottom tracks 406 and 408. For example, a fastener (not shown) is inserted through a side tab 416 of the infill wall support clip 402 to securely attach the infill wall support clip 402 to the top track 410. Furthermore, an abutment notch formed by the infill wall support clips 402 and 404 receive the corner of the top track 410.

Figure 5:
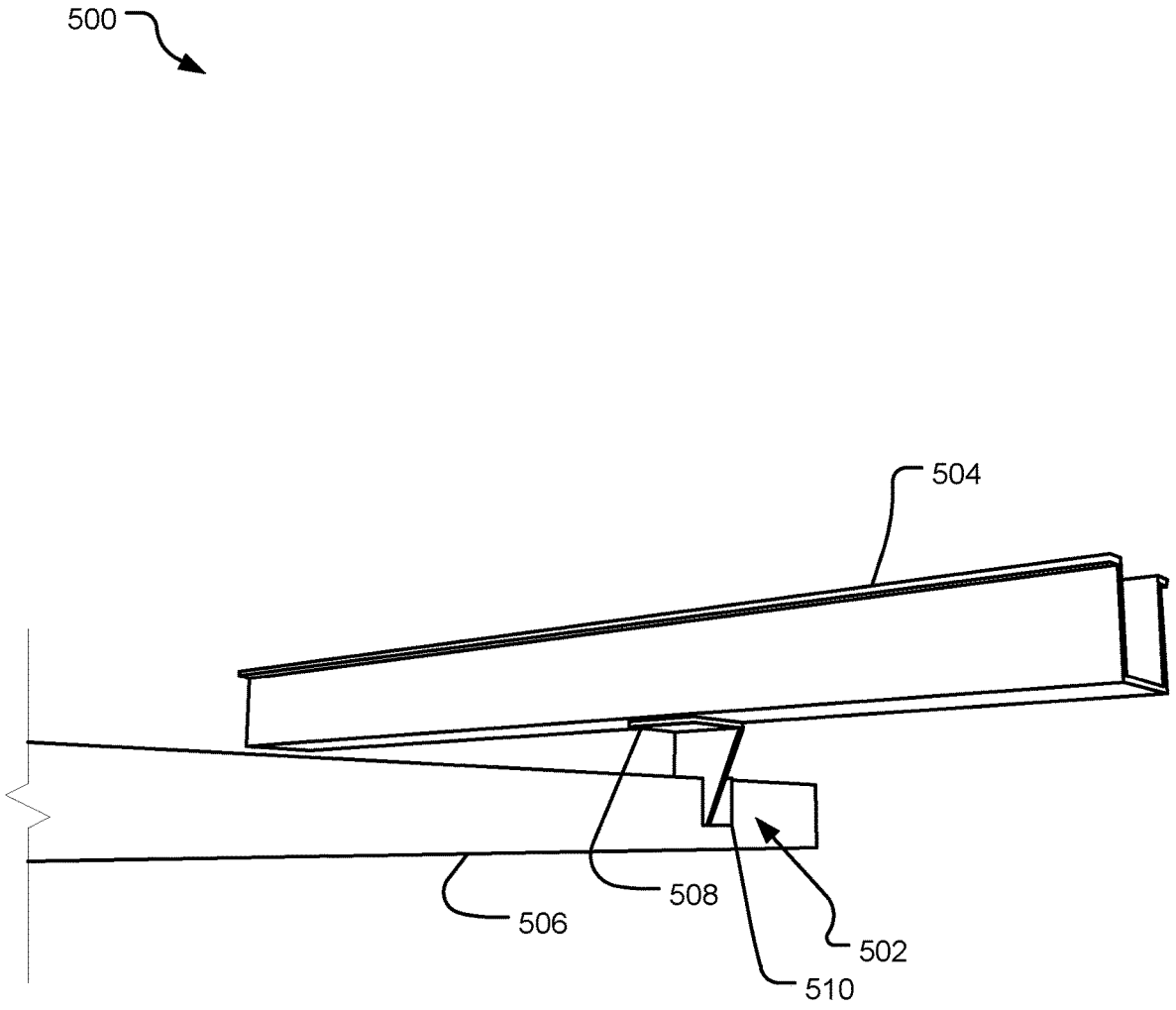
FIG. 5 illustrates an example view of a system including infill wall support clip installed between a top track of a wall panel and a bottom track of a floor truss.

FIG. 5 illustrates an example view 500 of a system including an infill wall support clip 502 installed between a top track 506 of a wall panel and a bottom track 504 of a floor truss. Alternatively, the infill wall support clip 502 installed between a top track 506 of a wall panel and a bottom track 504 of a joist or other structure. Fasteners (not shown) anchor the infill wall support clip 502 to the top track 506 and the bottom track 504. For example, one or more fasteners (e.g., screw, bolt) is inserted thorough a pilot hole of a top flange 508 of the infill wall support clip 502 to attach the infill wall support clip 502 to the bottom track 504. Furthermore, one or more fasteners may be inserted through a side tab 510 of the infill wall support clip 502 to securely fasten the infill wall support clip 502 to the top track 506.

Figure 6:
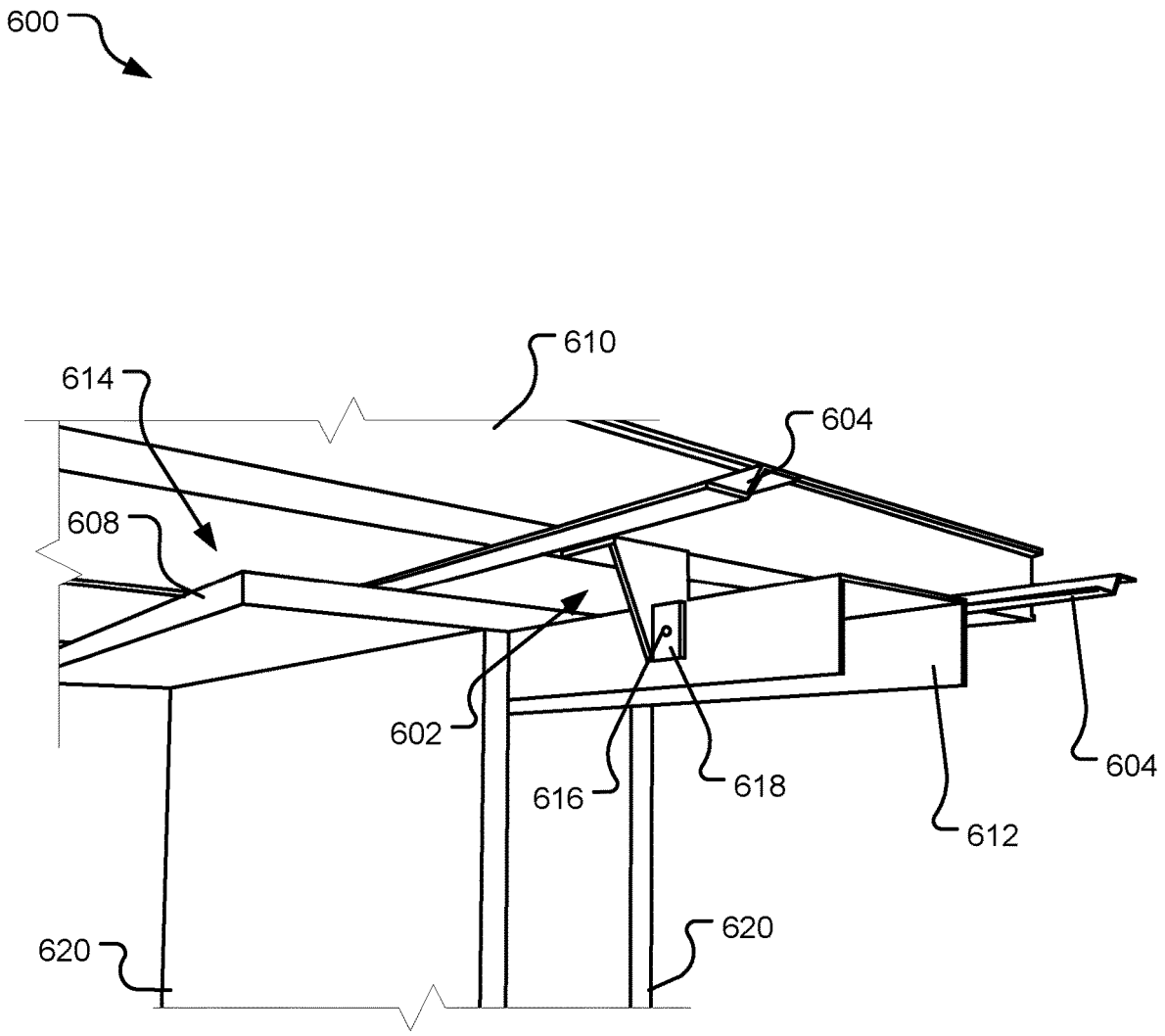
FIG. 6 illustrates an example view of a system including an infill wall support clip installed between a bottom track and a top track.

FIG. 6 illustrates an example view 600 of a system including an infill wall support clip 602 installed between a bottom track 610 and a top track 612 of a building structure. The infill wall support clip 602 is securely fastened to the top track 612 using a fastener 616 (e.g., a screw or bolt) inserted through a side tab 618 and the top track 612. A side flange 622 provides a spacing 614 and lateral support between the top track 612 and the bottom track 610. Furthermore, the side flange 622 transfers load between the truss (e.g., the bottom track 610) and the wall (e.g., the top track 612). The spacing allows for one or more pieces of the drywall 608 to be installed continuously above the top track 612. Furthermore, one or more resilient channels 604 may be installed between the drywall 608 and the bottom track 610. The resilient channels 604 may be securely fastened to the bottom track 610 using fasteners such as bolts or screws. In some implementations, the drywall 608 is fastened to the resilient channels 604 using fasteners such as bolts or screws and/or glue or tap. The resilient channels 604 provide support for the drywall 608 and sound insulation by dissipating sound waves that travel between the drywall 608 and the bottom track 610. One or more additional pieces of drywall 620 are installed on the sides of the top track 612.

Figure 7:
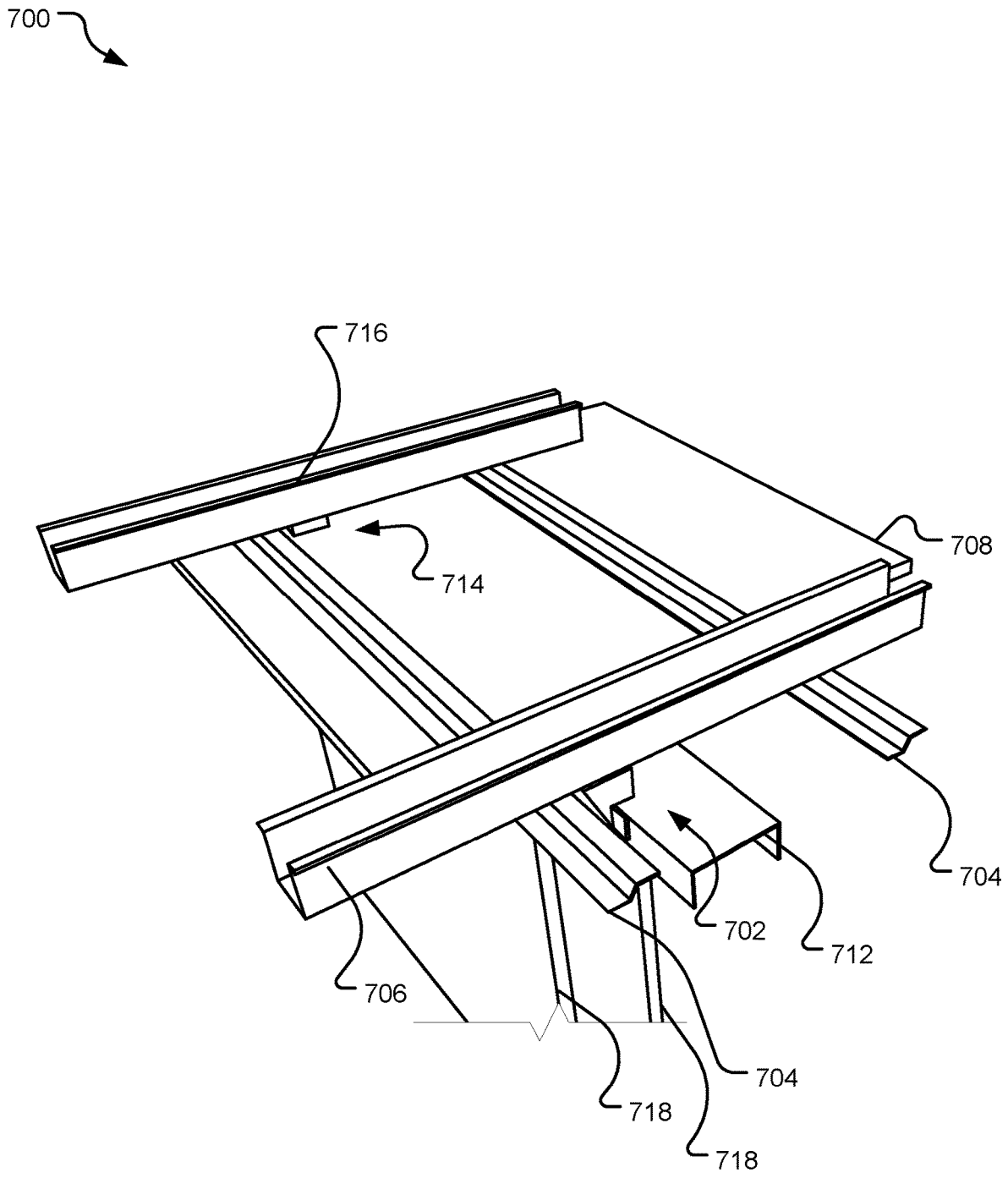
FIG. 7 illustrates an example view of a system including infill wall support clips installed between bottom tracks and a top track.

FIG. 7 illustrates an example view 700 of a system including an infill wall support clips 702 and 714 installed between bottom tracks 706 and 716 and a top track 712. The infill wall support clips 702 and 714 are securely attached to the top track 712 of a wall structure. The infill wall support clip 702 is attached to the bottom track 706 of a ceiling structure such as a truss panel. The infill wall support clip 714 is also attached to the bottom track 716 of the ceiling structure such as a truss panel. The infill wall support clips 702 and 714 provide spacing between the top track 712 and the bottom tracks 706 and 716 for the drywall 708 to be installed continuously over the top of the top track 712. The infill wall support clips 702 and 714 further provide spacing for resilient channels 704. The resilient channels may be securely fastened to the bottom tracks 706 and 716. The drywall may be securely fastened to the resilient channels 704. The resilient channels 704 provide support for the drywall 708 and sound insulation between the drywall 708 and other support structure such as the bottom tracks 706 and 716. One or more additional pieces of drywall 718 are installed on the sides of the top track 712 to provide walls.

Figure 8:
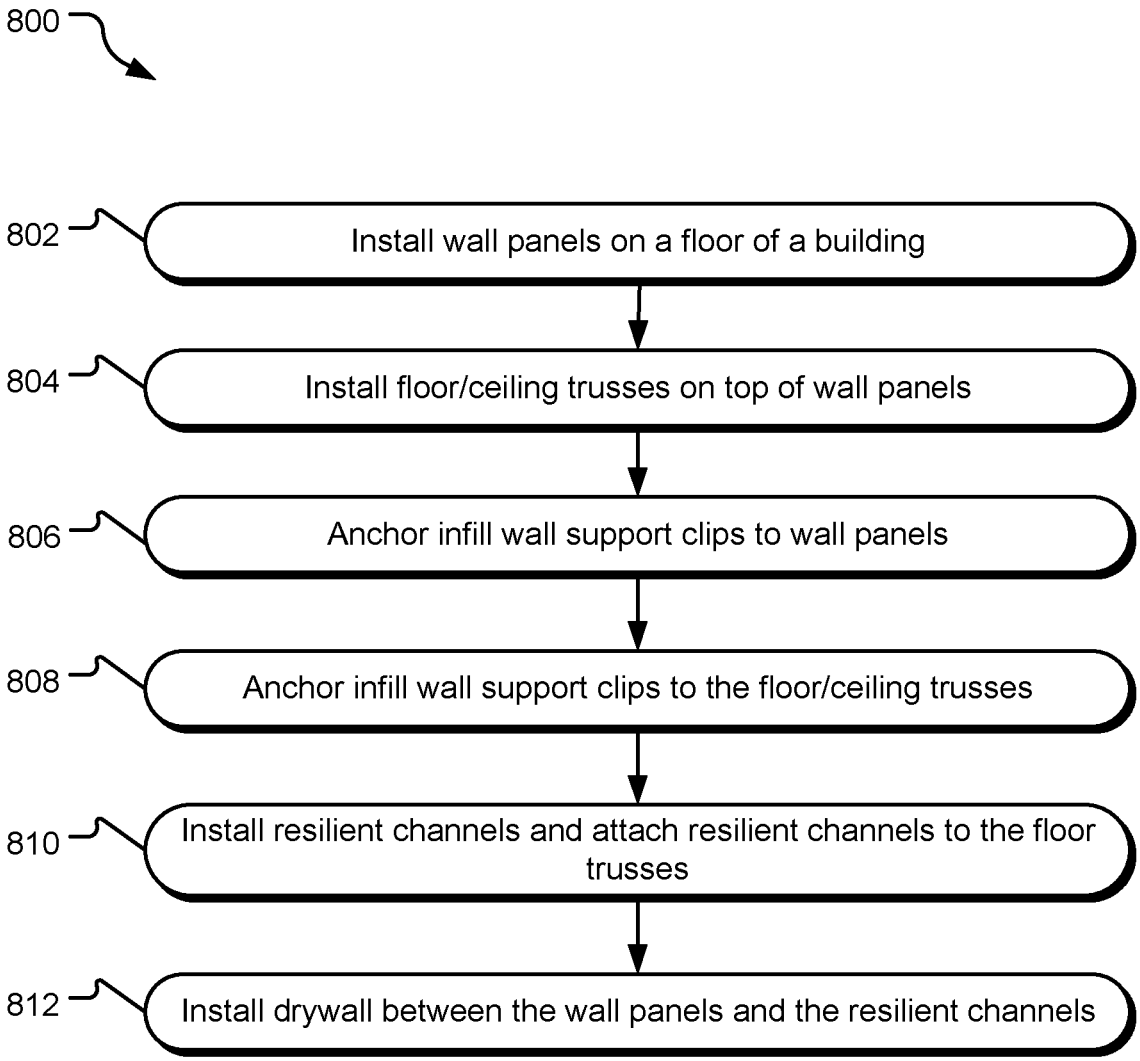
FIG. 8 illustrates example operations for using the infill wall support clips described herein.

FIG. 8 illustrates example operations 800 for using the infill wall support clips described herein. An installing operation 802 installs wall panels on a floor of a building. The wall panels may be attached to a concrete slab or trusses of a previous floor. An installing operation 804 installs floor/ceiling trusses on top of wall panels. An anchoring operation 806 anchors one or more infill wall support clips to the wall panels. In some implementations, the one or more infill wall support clips are attached to top tracks of wall panels. The infill wall support clips may be anchored in predetermined locations on various wall panels. The wall panels (e.g., top tracks of the wall panels) may have prefabricated pilot holes for receiving fasteners for attaching the infill wall support clips. An anchoring operation 808 anchors the infill wall support clips to the floor/ceiling trusses. In some example implementations, the infill wall support clips are anchored to bottom tracks of the floor/ceiling trusses. The floor/ceiling trusses (e.g., the bottom tracks) may include prefabricated pilot holes for receiving fasteners for anchoring the infill wall support clips. In other implementations, the pilot holes are drilled on site. It should be understood that the infill wall support clips may be attached to various other types of structural components such as beams.

An installing operation 810 installs resilient channels between the bottom tracks of the floor/ceiling trusses and the top tracks of the wall panels. The resilient channels may be securely fastened to the bottom tracks of the floor/ceiling trusses. An installing operation 812 installs drywall pieces between the top tracks of the wall panels and the resilient channels. The drywall may be attached to and supported by the resilient channels using fasteners, glue, or tape. The resilient channels provide support and sound insulation between the drywall and the supporting structure.

Figure 9:
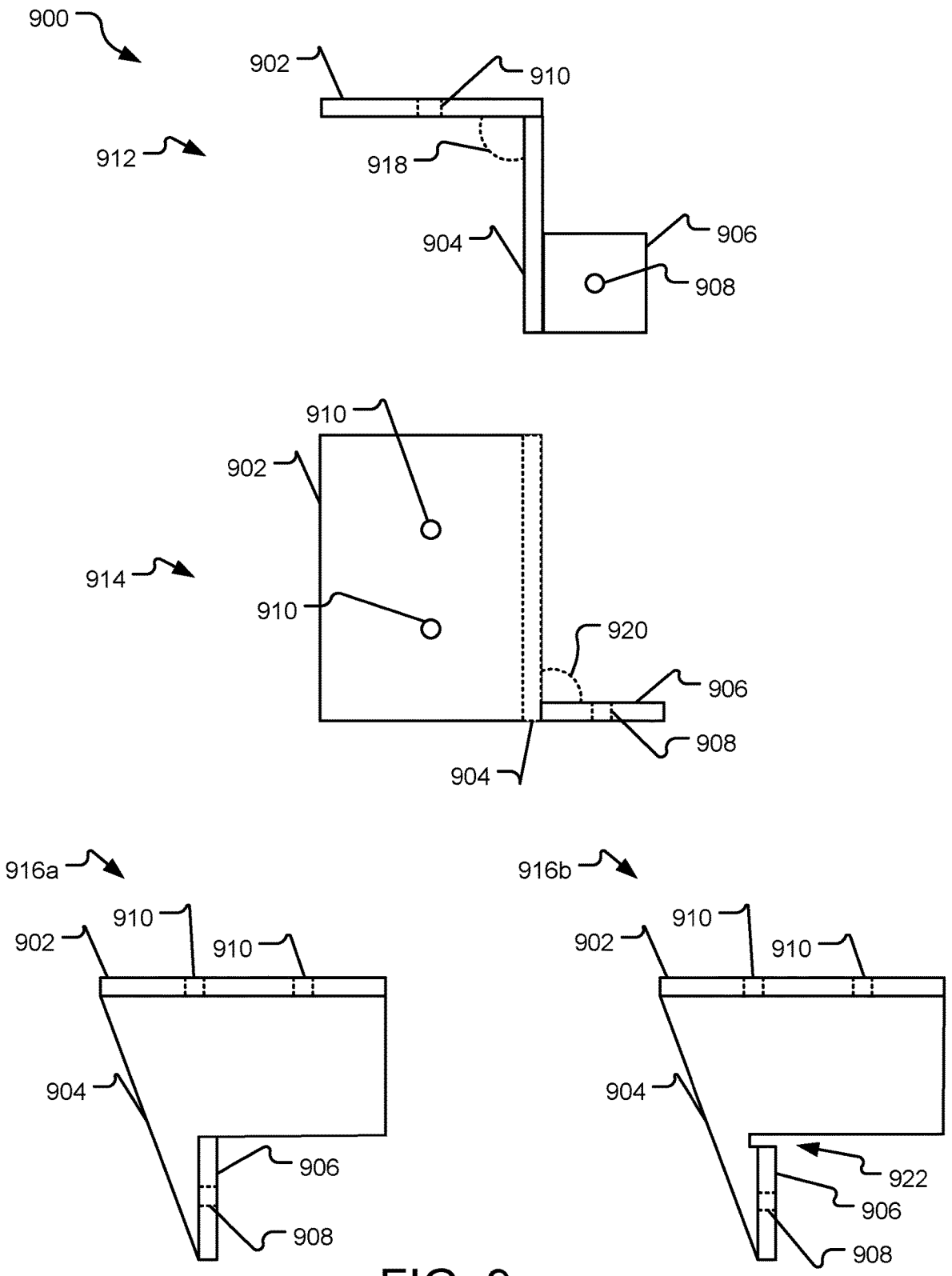
FIG. 9 illustrates various views of an example infill wall support clip described herein.

FIG. 9 illustrates various views of an example infill wall support clip 900 described herein. A view 912 is a side perspective view of the infill wall support clip 900. A view 914 is a top perspective view of the infill wall support clip 900. A view 916 (916*a* and 916*b*) is another side perspective view of the infill wall support clip 900. The infill wall support clip 900 includes a top flange 902, a side flange 904, and a side tab 906. The top flange 902 includes one or more pilot holes 910 for receiving fasteners for anchoring the infill wall support clip to a building component such as a truss. The side flange includes one or more pilot holes 908 for anchoring the infill wall support clip 900 to a building component such as a wall.

An angle 918 between the top flange 902 and the side flange 904 may be around 90 degrees (e.g., the top flange 902 and the side flange 904 are substantially perpendicular). It should be understood that in some implementations, the angle 918 may be from about 60 to about 120 degrees. Similarly, an angle 920 between the side tab 906 and the side flange 904 may be around 90 degrees (e.g., the side tab 906 and the side flange 904 are substantially perpendicular). It should be understood that in some implementations, the angle 920 may be from about 60 to about 120 degrees.

In the view 916*b*, a notch 922 is illustrated. The notch 918 may be formed as a result of the manufacturing process of the infill wall support clip 900. In some implementations, the infill wall support clip is formed of a continuous piece of metal or steel. To form the side tab 906, the piece of metal is cut (e.g., using a saw, laser, etching device), and the side tab 906 is folded or bent into position. The notch 922 is formed by the cutting process, which removes material of the piece of metal so that the side tab 906 may be folded into position.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims. Although the present invention has been described with reference to preferred embodiments, workers skilled in the art will recognize that changes may be made in form and detail without departing from the scope of the invention. The implementations described above and other implementations are within the scope of the following claims.

What is claimed is:

1. An infill wall support clip comprising:

a top flange configured to anchor the infill wall support clip to a truss such that the infill wall support clip is directly attached to the truss, the top flange forming a first plane;

a side tab configured to anchor the infill wall support clip to a wall panel, the side tab forming a second plane that is substantially perpendicular to the first plane; and a side flange connected between the top flange and the side tab, the side flange configured to provide spacing between the truss and the wall panel and to transfer vertical load from the truss to the wall panel, the side flange forming a third plane that is substantially perpendicular to the first plane and the second plane.

2. The infill wall support clip of claim 1, wherein the top flange provides spacing between a top track of the wall panel and a bottom track of a floor structure.

3. The infill wall support clip of claim 2, wherein the spacing provided by the side flange allows for sound dissipating elements to be installed.

4. The infill wall support clip of claim 2, wherein the spacing provided by the side flange allows for resilient channels to be installed between the top track of the wall panel and the bottom track of the floor structure.

5. The infill wall support clip of claim 1, wherein the side flange includes one or more slots configured to dissipate sound vibrations.

6. The infill wall support clip of claim 1, wherein the side tab and the side flange form an abutment notch configured to receive a top track of a wall structure.

7. The infill wall support clip of claim 6, wherein the abutment notch provides support for a bottom track of a floor truss.

8. A system comprising:

a truss;

a wall panel; and an infill wall support clip anchored to the truss and the wall panel, the infill wall support clip comprising:

a top flange configured to anchor the infill wall support clip to a truss such that the infill wall support clip is directly attached to the truss, the top flange forming a first plane;

a side tab configured to anchor the infill wall support clip to a wall panel, the side tab forming a second plane that is substantially perpendicular to the first plane; and a side flange connected between the top flange and the side tab, the side flange configured to provide spacing between the truss and the wall panel and to transfer vertical load from the truss to the wall panel, the side flange forming a third plane that is substantially perpendicular to the first plane and the second plane.

9. The system of claim 8, further comprising:

one or more pieces of drywall overlaid over the wall panel and below the truss and in a space provided by the infill wall support clip.

10. The system of claim 8, wherein the top flange of the infill wall support clip provides spacing between a top track of the wall panel and a bottom track of a floor structure.

11. The system of claim 10, wherein the spacing provided by the side flange of the infill wall support clip allows for sound dissipating elements to be installed.

12. The system of claim 10, wherein the spacing provided by the side flange of the infill wall support clip allows for resilient channels to be installed between the top track of the wall panel and the bottom track of the floor structure.

13. The system of claim 10, wherein the side flange of the infill wall support clip includes one or more slots configured to dissipate sound vibrations.

14. The system of claim 8, wherein the side tab and the side flange of the infill wall support clip form an abutment notch configured to receive a top track of a wall structure.

15. The system of claim 14, wherein the abutment notch provides support for a bottom track of a floor truss.

16. The system of claim 8, wherein the infill wall support clip is anchored to the truss via one or more fasteners inserted through one or more pilot holes of a top flange of the infill wall support clip.

17. A method comprising:

anchoring a top flange of an infill wall support clip to a bottom track of a truss such that the infill wall support clip is directly fastened to the truss, the top flange forming a first plane;

anchoring a side tab of the infill wall support clip to a top track of a wall panel, the side tab forming a second plane that is substantially perpendicular to the first plane; and installing one or more pieces of drywall in a space between the truss and the wall panel provided by a side flange of the infill wall support clip, the side flange forming a third plane that is substantially perpendicular to the first plane and the second plane.

18. The method of claim 17, further comprising:

anchoring the infill wall support clip to the wall panel using wall panel fasteners inserted through the side tab of the infill wall support clip.

19. The method of claim 17 further comprising:

installing one or more resilient channels between the truss and the wall panel, the one or more pieces of drywall being installed between the one or more resilient channels and the wall panel, the one or more resilient channels providing support for the one or more pieces of drywall and providing sound insulation between the one or more pieces of drywall and the truss.

20. The method of claim 17, wherein the side tab and the side flange form an abutment notch configured to receive a top track of a wall structure.

* * * * *